US006192137B1

(12) United States Patent
Heo

(10) Patent No.: US 6,192,137 B1
(45) Date of Patent: Feb. 20, 2001

(54) GARMENT CAPABLE OF OUTPUTTING A SOUND

(75) Inventor: Juil Heo, Seoul (KR)

(73) Assignee: T. S. Marketing Co., Ltd., Seoul (KR)

( * ) Notice: Under 35 U.S.C. 154(b), the term of this patent shall be extended for 0 days.

(21) Appl. No.: 09/365,516

(22) Filed: Aug. 2, 1999

(30) Foreign Application Priority Data

Mar. 11, 1999 (KR) ..... 99-3851

(51) Int. Cl.[7] ..... H04R 25/00

(52) U.S. Cl. ..... 381/386; 381/388; 381/300; 381/301; 381/332; 24/3.1; 2/224; 2/912; 2/913

(58) Field of Search ..... 381/361, 364, 381/366, 374, 386, 388, 301, 300, 304, 305, 332; 24/3.1; 2/224, 912, 913

(56) References Cited

U.S. PATENT DOCUMENTS 4,100,653 * 7/1978 Sesabaugh ..... 24/3
4,489,770 * 12/1984 Reich ..... 150/52
4,539,700 * 9/1985 Sato ..... 381/90
4,589,134 * 5/1986 Waldron ..... 381/90
4,764,962 * 8/1988 Ekman ..... 381/24
4,860,364 * 8/1989 Giannini ..... 381/90
5,109,421 * 4/1992 Fox ..... 381/90
5,201,002 * 4/1993 Dahlem ..... 381/24
5,757,929 * 5/1998 Wang ..... 381/24
5,764,776 * 6/1998 Francais ..... 381/24
6,023,516 * 2/2000 Rifkind ..... 381/301
6,097,822 * 8/2000 Min ..... 381/301

* cited by examiner

*Primary Examiner*—Curtis A. Kuntz
*Assistant Examiner*—Dionne Harvey
(74) *Attorney, Agent, or Firm*—Skjerven Morrill MacPherson LLP; Alan H. MacPherson

(57) ABSTRACT

In a garment which can receive a printed circuit board having a sound synthetic chip (10), a sound outputting element (12), a switch (14), a battery (15) and the like mounted on the printed circuit board (20) and which is capable of outputting a sound or breaking the output of the sound by operating the switch (14), said garment comprises a button exposing hole (32) for exposing at least a portion of the button (14*a*) of said switch (14) and said sound outputting element (12) in front of it; and a moisture-proof paper (70) being positioned between an inner surface of said non-woven fabric pocket (30) and an rear surface of said printed circuit board (20).

4 Claims, 9 Drawing Sheets

GARMENT CAPABLE OF OUTPUTTING A SOUND

BACKGROUND OF THE INVENTION

1. Field of the Invention

The present invention relates to a garment and more particularly to a garment having a structure capable of inserting a printed circuit board mounted with a sound synthetic circuit thereinto, adapted for user worn the garment to listen to music by operating an auxiliary button installed in the outer of the garment while walking and adapted for the printed circuit board to be removed from the garment for cleaning the garment.

2. Description of the Prior Art

As well-known, garment has been developed, considering features ranging from a concept of practicability which can control a cold and heat in accordance with a climatic change or protect a body from the outside interference to a concept of an ornamentation and a social relationship.

An object of wearing such garment is largely divided into that for a protection of the body or activity and relaxation, and that for an ornamentation or ceremonies, mark and classification in a social life.

Since such general garment is only made in view of a design in appearance, if a user wishes to listen to music while walking, he has to put a portable cassette tape player in a pocket of garment that he wears or carry the player with a separate bag and thusly there are a problem of his activity's inconvenience because of its large volume and weight. In particular, in case that he enjoys dance or plays while listening to the music, the cassette player in the porket of garment that he worn or in his bag is susceptible to a trouble due to a vibration or impact and thusly there may be a problem of the restriction in such activity as a vigorous play or dance.

SUMMARY OF THE INVENTION

Accordingly, the present invention is designed to solve such problems. It is the object of the present invention to provide a garment capable of outputting a sound, adapted to enjoy the music while walking and move without the restriction of activity, with simple putting of such sound player on the garment that user wears.

To achieve the object of the present invention, in a garment which can receive a printed circuit board having a sound synthetic chip, a sound outputting element, a switch, a battery and the like mounted on the printed circuit board and which is capable of outputting a sound or breaking the output of the sound by operating the switch, said garment comprises a button exposing hole for exposing at least a portion of the button of said switch and said sound outputting element in front of it; an outputting element passing-through hole; a non-woven fabric pocket having a cover portion for opening or covering an opening portion formed on the upper end of it by means of a first velcro tape; a cutting portion being sewn within an inner surface of the garment, having a opening portion on the upper thereof opened or closed by a second velcro tape and exposing a button from the front of the garment in a state that said non-woven fabric pocket is received into the inner of the garment; an internal pocket having a sound wave passing hole for passing a sound wave being generated from said sound outputting element; an auxiliarly button being attached in front of the garment so as to cover from outside said cutting portion formed in the garment and having a button inserting hole for inserting a button; and a moisture-proof paper being positioned between an inner surface of said non-woven fabric pocket and an rear surface of said printed circuit board.

Hereinafter, an embodiment according to the present invention will be described in detail with reference to the accompanying drawings, wherein;

DESCRIPTION OF THE PREFERRED EMBODIMENT

Figure 1:
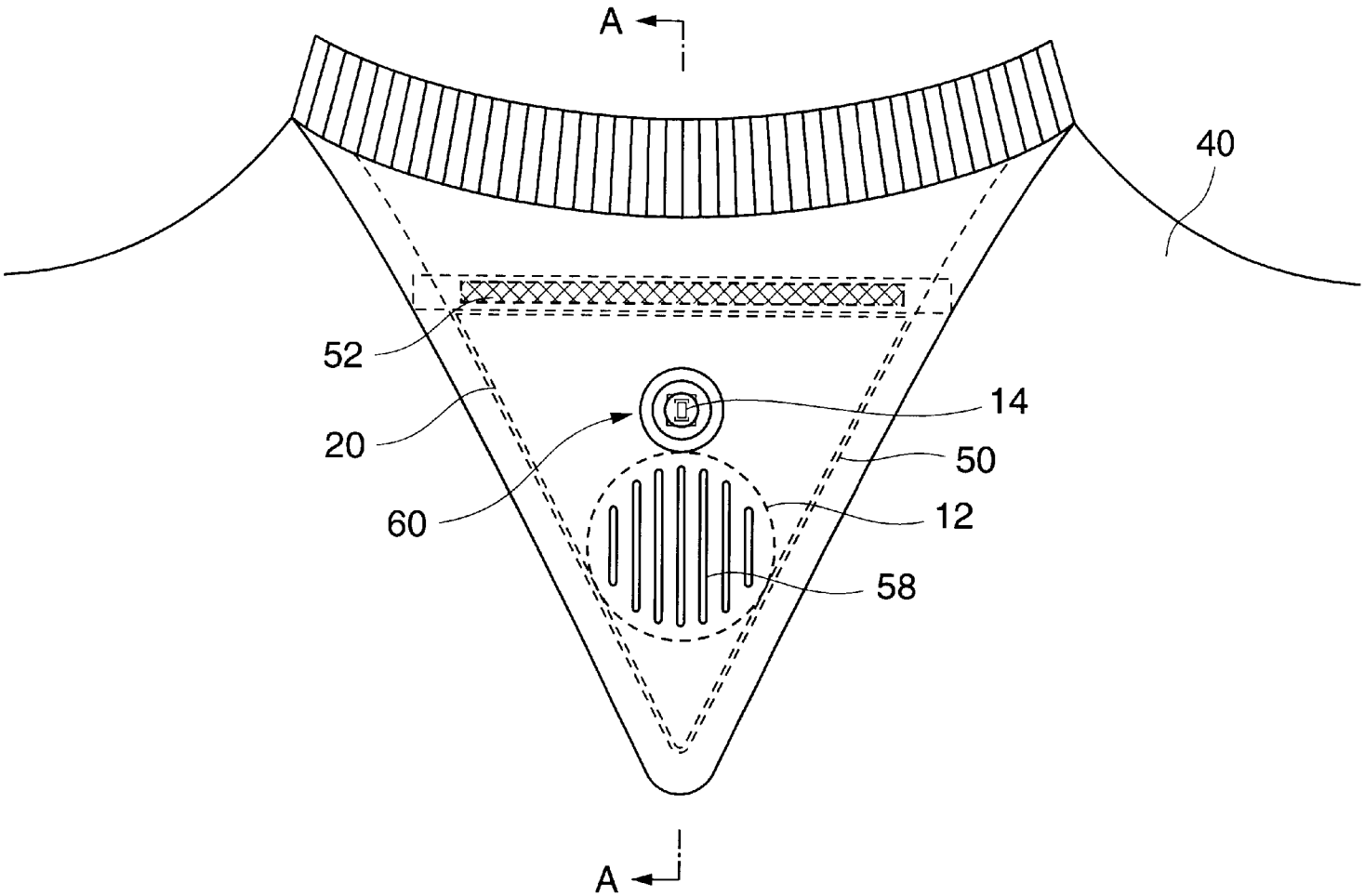
FIG. 1 is a front view showing a construction of garment capable of outputting a sound according to the present invention.
Figure 2:
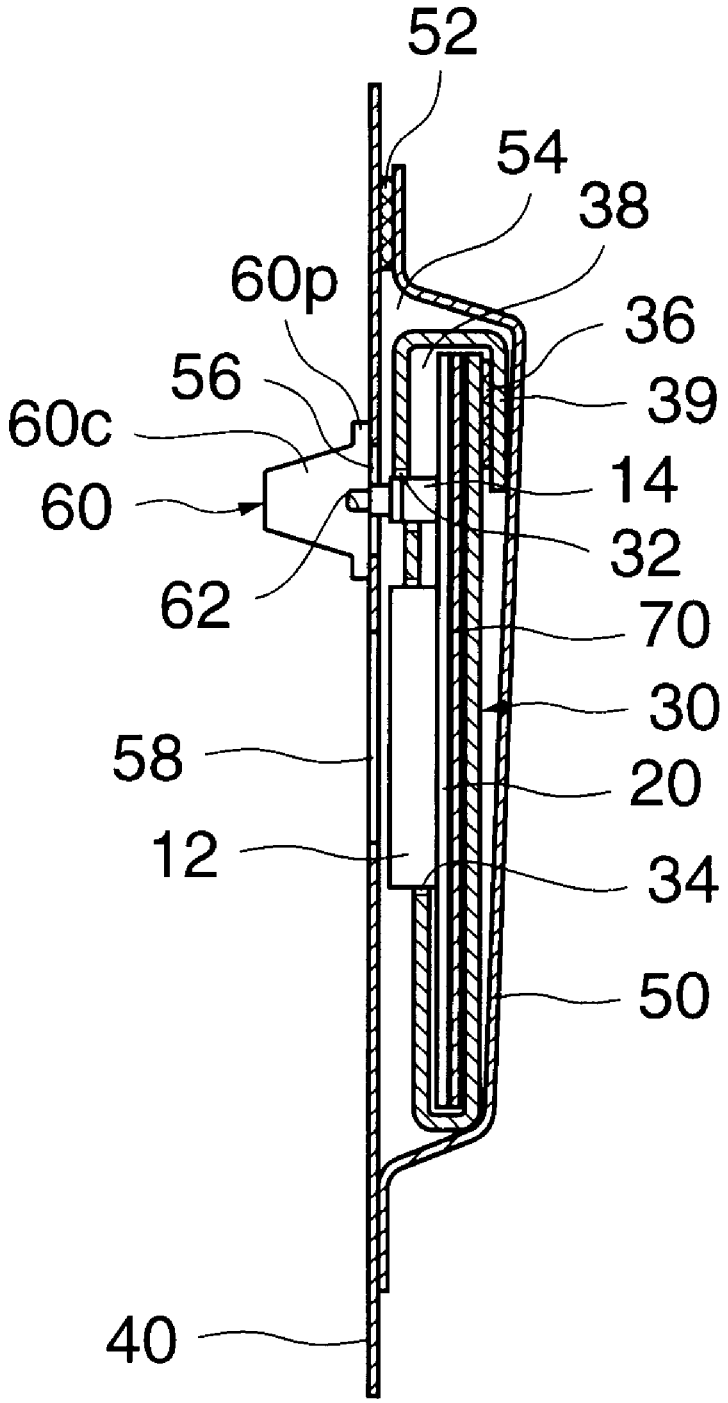
FIG. 2 is a sectional view along line A—A of FIG. 1.
Figure 3:
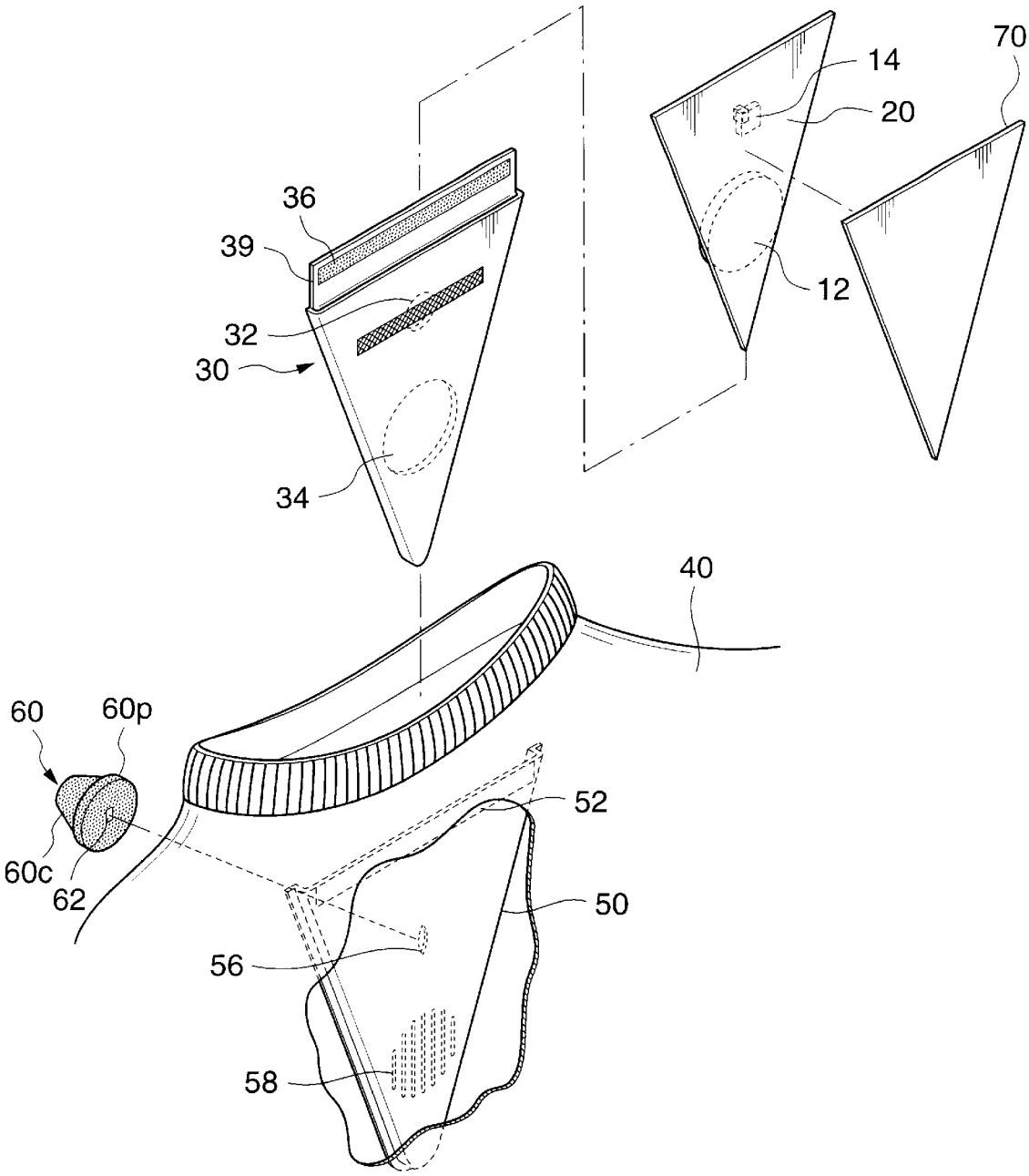
FIG. 3 is a rear perspective view showing a structure of garment capable of outputting a sound according to the present invention.
Figure 4:
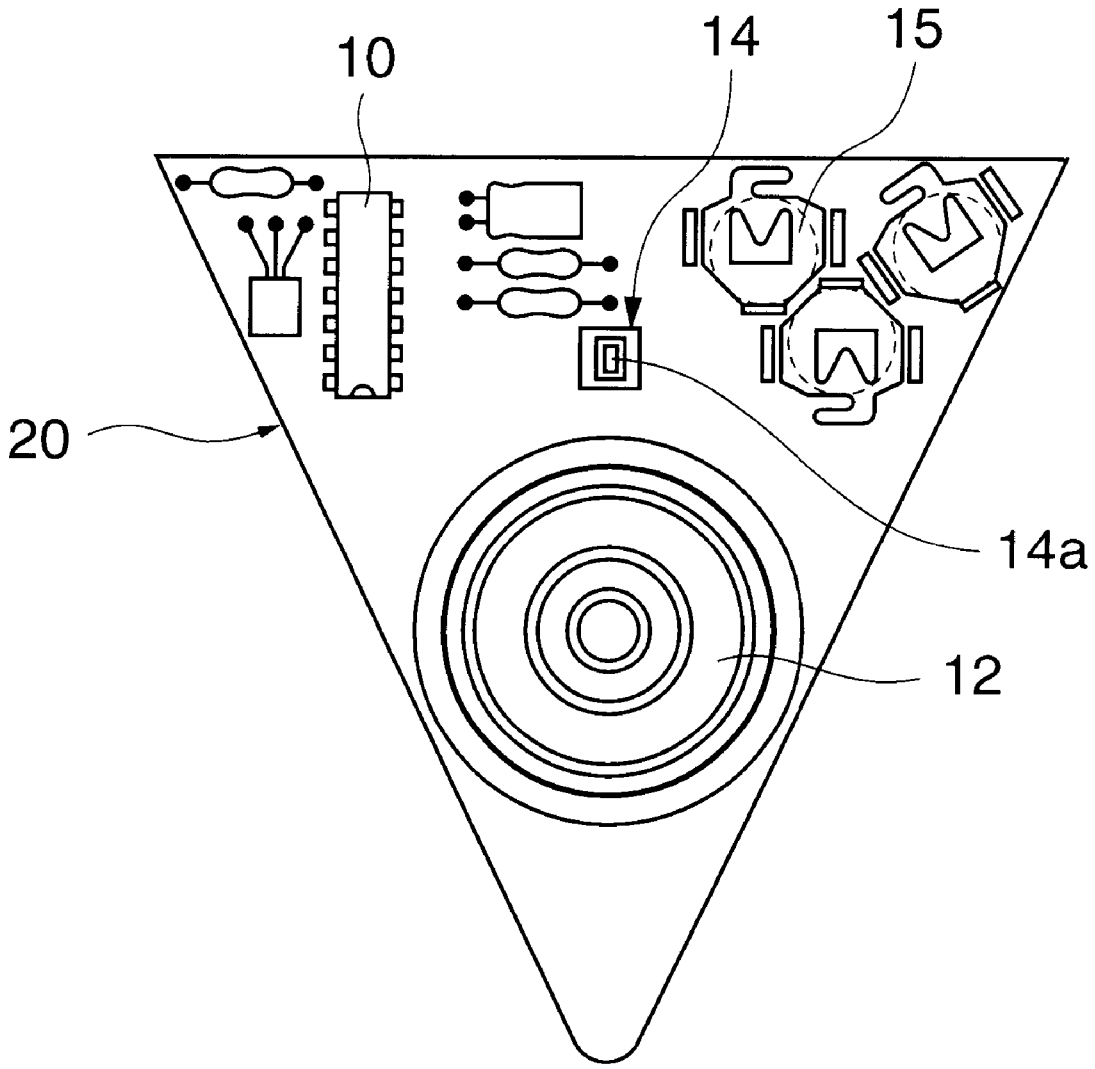
FIG. 4 is a front view showing a printed circuit board adapted to the garment capable of outputting a sound.
Figure 5:
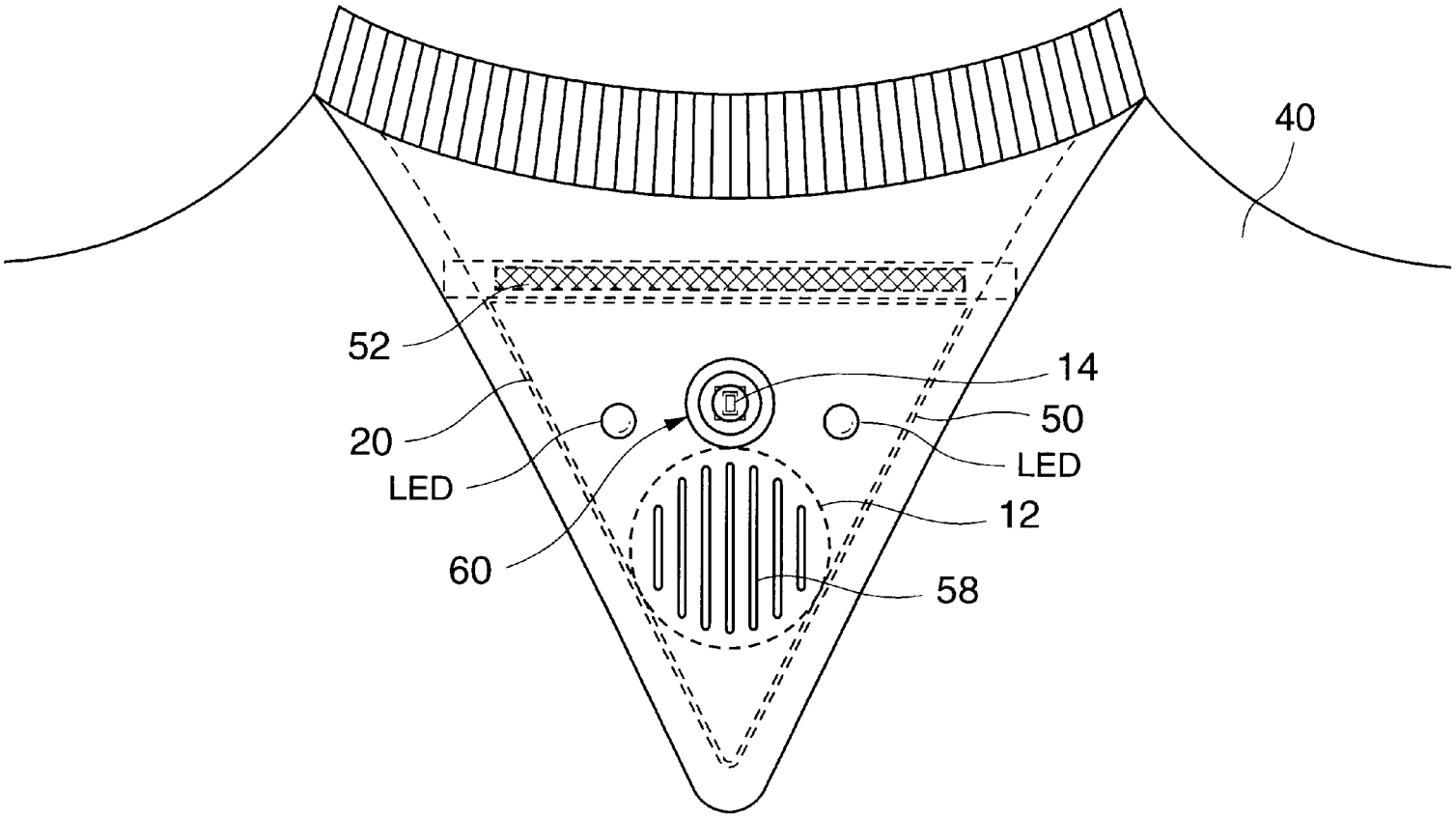
FIG. 5 is a view showing a state that a light emission diode is installed on a printed circuit board adapted to the garment capable of outputting a sound according the present invention.

As shown in FIG. 1 to FIG. 4, in a garment which can receive a printed circuit board having a sound synthetic chip (10), a sound outputting element (12), a switch (14), a battery (15) and the like mounted on the printed circuit board (20) and which is capable of outputting a sound or breaking the output of the sound by operating the switch (14), said garment comprises a button exposing hole (32) for exposing at least a portion of the button **(14*a*) of said switch (14) and said sound outputting element (12) in front of it; an outputting element passing-through hole (34); a non-woven fabric pocket (30) having a cover portion (39) for opening or covering an a first opening portion (38) formed on the upper end of it by means of a first velcro tape (36); a cutting portion (56) being sewn within an inner surface of the garment (40), having a second opening portion (54) on the upper thereof opened or closed by a second velcro tape (52) and exposing a button (14*a*) from the front of the garment (40) in a state that said non-woven fabric pocket (30) is received into the inner of the garment (40); an internal pocket (50) having a sound wave passing hole (58) for passing a sound wave being generated from said sound outputting element (12); an auxiliarly button (60) being attached in front of the garment (40) so as to cover from outside said cutting portion (56) formed in the garment (40) and having a button inserting hole (62) for inserting a button (14); and a moisture-proof paper (70) being positioned between an inner surface of said non-woven fabric pocket (30) and an rear surface of said printed circuit board (20**).

That is, said sound outputting element (12) mounted on said printed circuit board (20) can be constructed as a speaker or piezo-electric element, but it is not intended to be limited to such construction.

Said moisture-proof paper (70) is constructed as a material such as a vinyl which does not passing a moisture.

In said garment (40), there are provided a plurality of sound wave passing holes (58) which are formed by having holes extended longly in the longitudinal direction with a fine width and having them arranged at equal distance in the transverse direction. But, said sound wave passing holes (58) can be formed of a plurality of circular holes without being limited to it.

Although said printed circuit board (20), non-woven fabric pocket (30) and internal pocket (50) are formed of a reversed triangle shape, respectively, but it is not limited to only such shape.

Said auxiliarly button (60) comprises a flange portion for covering said cutting portion (56) and an operating portion (60*c*) of a circle post shape which is operated by a hand pushing, and is formed of a rubber of a soft material so that while operating, said flange portion (60*p*) can press the button (14*a*) by causing an elastic deformation concavely in the rear direction.

Also, said auxiliarly button (60) can be fixed to said garment (40) by means of a connecting means such as sewing or high-frequency connecting technique. But, it is not limited to only such means As shown in FIG. 5 to FIG. 9., a light emitting diode (LED) is connected to said sound outputting element (12) in parallel, and thusly when pushing said switch (14), said light emitting diode and said sound outputting element (12) are operated simultaneously.

That is, while a strength of current flowing to said light emitting diode (LED) varies in accordance with a strength of current flowing to said sound outputting element (12), a brightness of said light emitting diode (LED) varies in accordance with a strength of sound.

Figure 6:
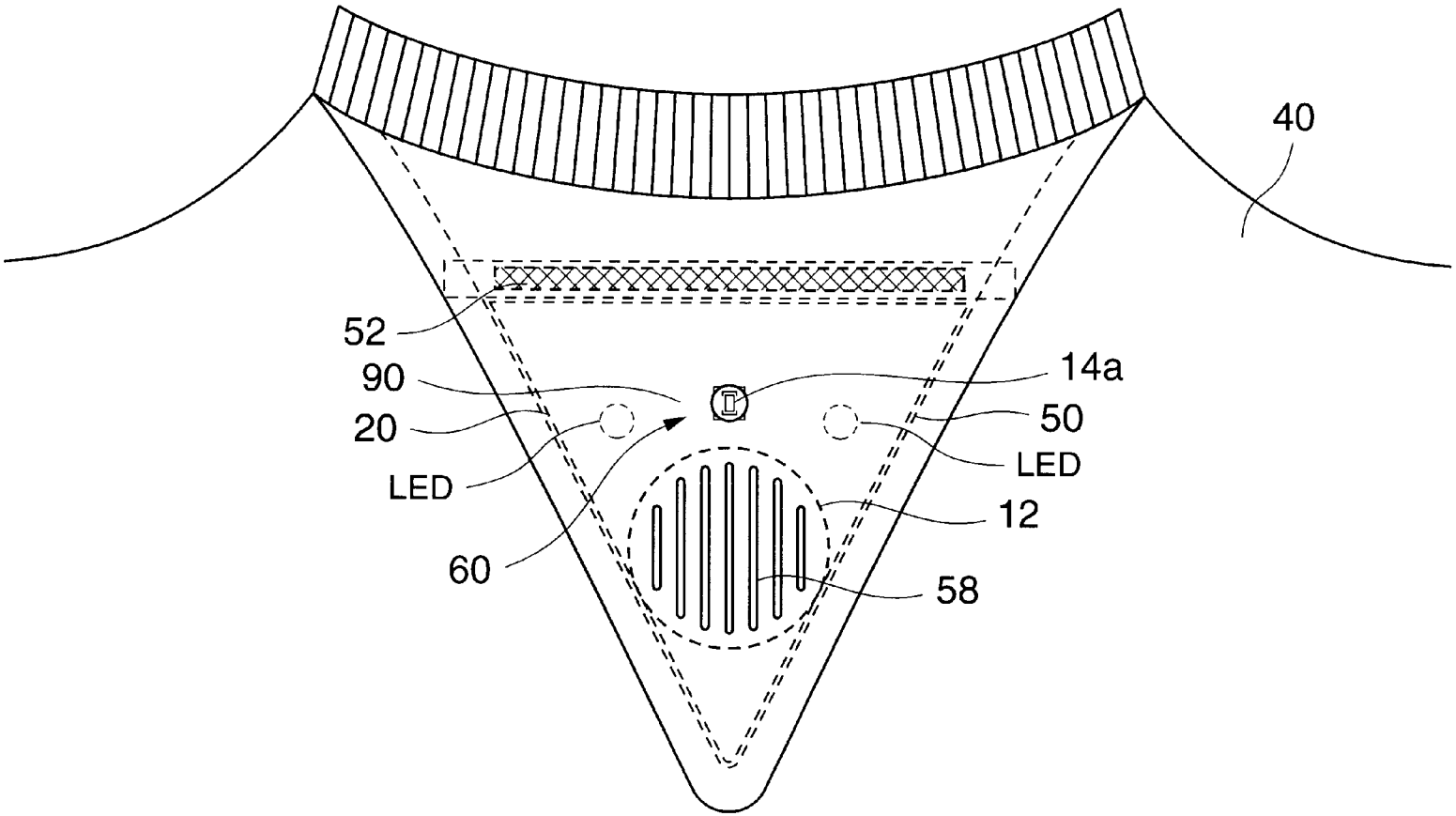
FIG. 6 is a front view showing a state that a switch installed on the garment capable of outputting a sound is hidden in the inner of the garment.
Figure 7:
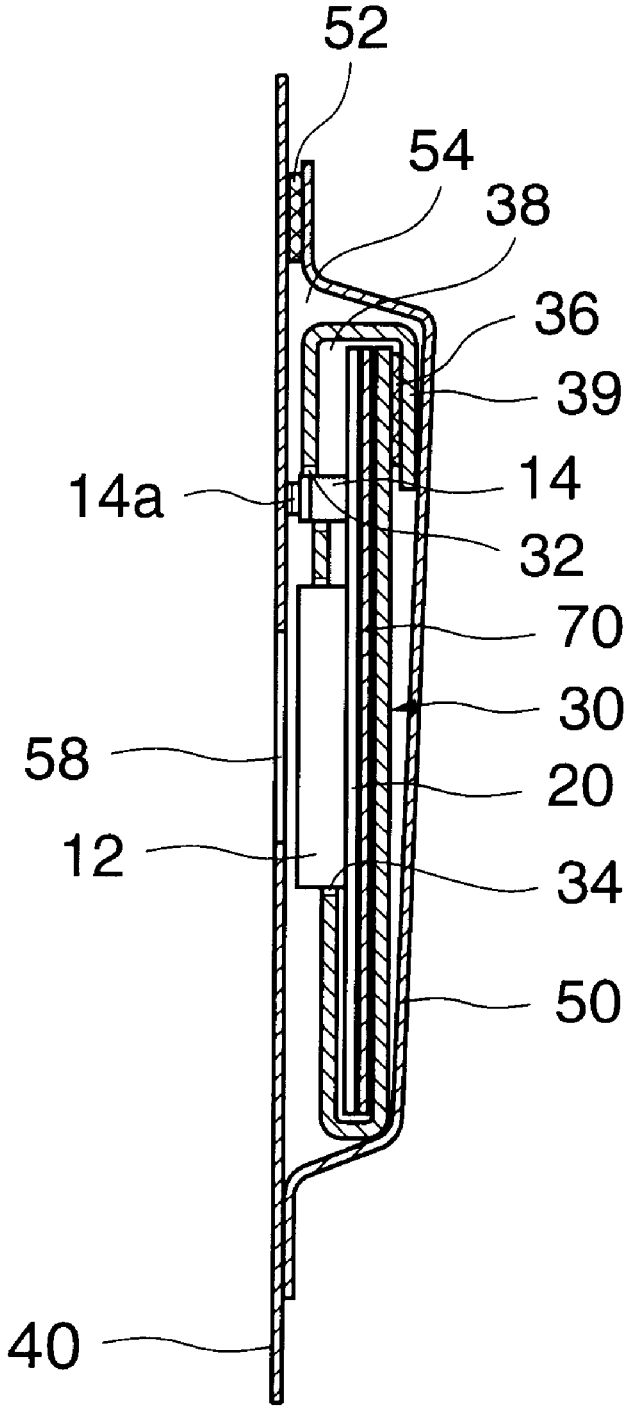
FIG. 7 is a sectional view showing a state that a switch installed on the garment capable of outputting a sound is hidden in the inner of the garment.
Figure 8:
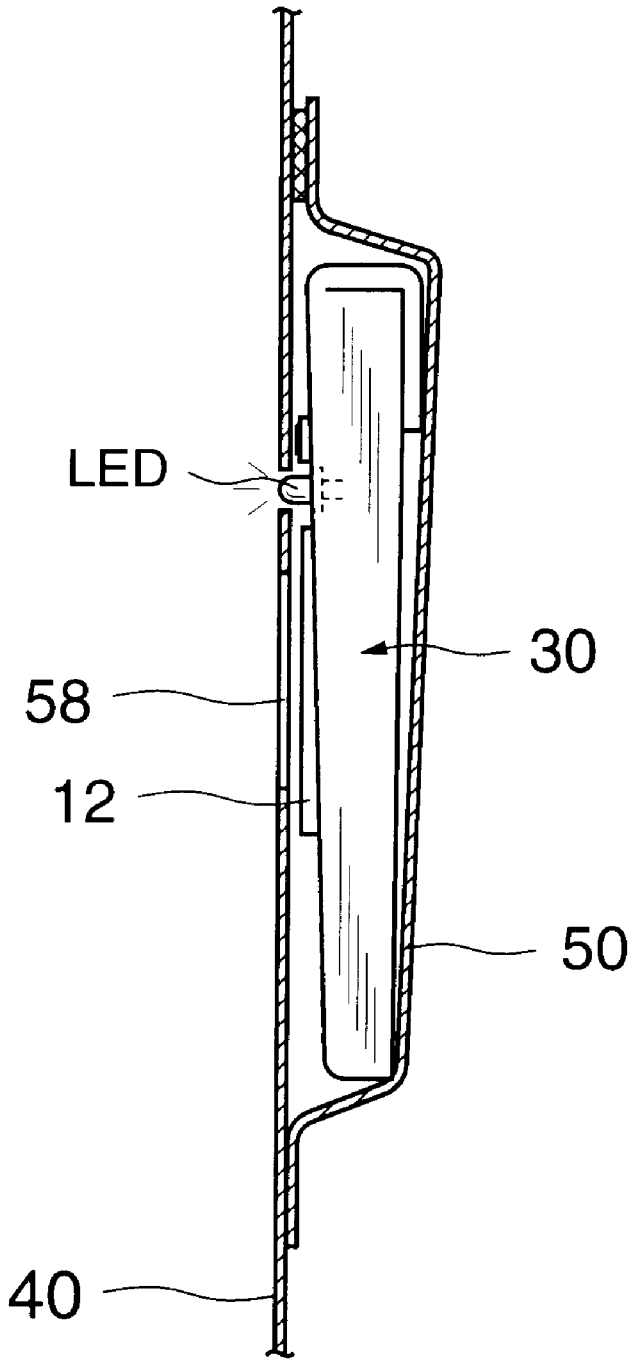
FIG. 8 is a sectional view showing a state that a light emission diode adapted to the garment capable of outputting a sound according the present invention is installed to be exposed to the outer of the garment.
Figure 9:
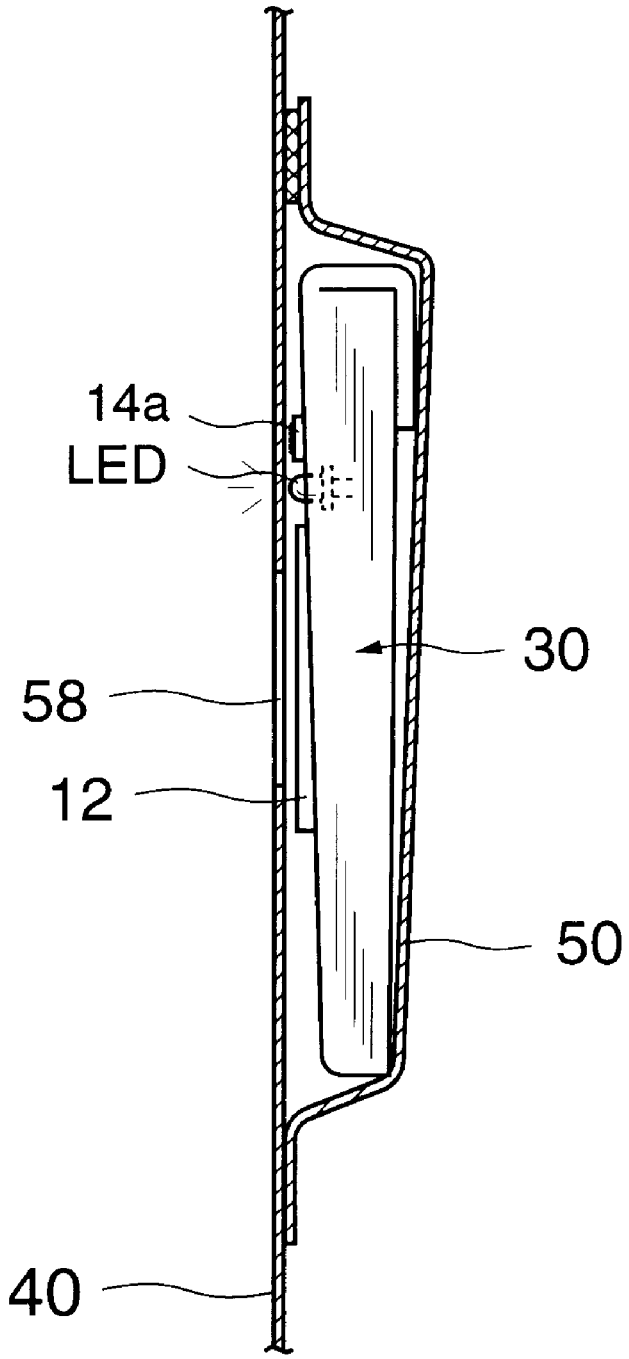
FIG. 9 is a sectional view showing a state that a light emission diode adapted to the garment capable of outputting a sound according the present invention is installed to be positioned on the inner of the garment.

As shown in FIG. 6 and FIG. 9, also, since said light emitting diode (LED) is positioned on the inner of said garment (40), it is possible to see said light emitting diode through the garment from outside.

Alternatively, in case that it is intended fox said switch (14) to be hidden by the garment (40), it is possible to form a mark on the surface of the garment(40) so that the position of button (14*a*) can be identified.

Said light emitting diode (LED) can be connected with a current limiting resistor (not shown) in serial in order to prevent the light emitting diode from being destroyed due to an flowing of current over an rated current thereon.

Hereinafter, an acting effect according the present invention will be described in detail with reference to the accompanying drawings.

As shown in FIG. 1 to FIG. 9, if pressing an auxiliarly button (60) installed in front of garment (40), a button (14*a*) which is inserted into a button inserting hole (62) in the auxiliarly button (60) is pressed, a contact point of the switch (14) is switched and then a sound synthetic chip (10) is derived and at the same time, a melody sound is outputted from a sound outputting element (12).

At this time, a forward current is supplied to the light emitting diode connected to the sound outputting element (12) in parallel, causing the diode to flicker, and the light emitting diode (LED) is switched off or its brightness varies in accordance with an flowing direction of a strength of current supplied to the sound outputting element (12). That is, the light emitting diode is flickered in accordance with sound outputted through the sound outputting element (12), thereby providing a visual effect.

Meanwhile, since the auxiliarly button (60) is formed of a soft material such as a rubber, a flange portion (60*p*) causes an elastic deformation concavely during pressing, and thusly a button (14*a*) receives a pressure.

In such situation, a melody sound outputted from the sound outputting element (12) is outputted outside through sound wave passing holes (58) formed in the garment (40), and if pressing again the auxiliary button, driving of the sound synthetic is stopped, and such effect is occurred as seen in a device using a general sound synthetic chip.

When an user tries to clean the garment (40) or replace one printed circuit board inserted previously in the garment with other one, he separates a second velcro tape (52) in an internal pocket (50) and then fetches outside a non-woven fabric pocket (30) which is received in the inner therof, therby the garment (40) including the internal pocket (5) and the auxiliarly button (60) is ready to be cleaned. Also, if user separates a first velcro tape (36) which is formed on the non-woven fabric pocket (60) fetched outside, opens a first opening portion (38) with turning over the cover portion (39), puts other printed circuit board into the empty, non-woven fabric pocket through the first opening portion, and then shuts the first opening portion (38) using the first velcro tape (36), a button (14*a*) of switch (14) mounted in the printed circuit board (20) is exposed in front of the non-woven fabric pocket (60) through the button exposing hole (32) and at the same time, the sound outputting element (12) is also exposed in front through a sound outputting element passing hole (34) formed in the non-woven fabric pocket (60).

Thereafter, if the user inserts the non-woven fabric pocket having the printed circuit board (20) received thereon into the inner thereof through the empty, second opening portion (54) and at the same time, passes the button (14*a*) through the cutting portion (56) formed in the garment (40) and inserts the button (14*a*) into the button inserting hole (62) formed in the auxiliarly button (14), the non-woven fabric pocket (60) can be received into the inner pocket (50) of the garment (40).

And then, when the second opening portion is shut using the second velcro tape (52), there is no any vibration while walking and there is also no any falling down of such music device in case of standing on hand. As described above, the present invention has a effect capable of enjoying the music while walking by simply receiving such music device into the garment, using separately non-woven fabric pocket and the internal pocket formed on the garment and can prevent the printed circuit board having a sound synthetic chip from being separated by using the cover portion and the velcro tape. In particular, since it can be made of a light structure, a effect is produced in running or dancing without a limitation of an activity. Further, it can be constructed so as to insert the printed circuit board having the sound synthetic circuit into the garment, the productive quality of the garment in improved and the demand of the product can be increased. Also, the light emitting diode flickering in accordance with a strength and/or weakness of sound can provide a viewer at night with an aesthetic effect.

What is claimed is:

1. In a garment which can receive a printed circuit board having a sound synthetic chip (10), a sound outputting element (12), a switch (14), a battery (15) and the like mounted on the printed circuit board (20) and which is capable of outputting a sound or breaking the output of the sound by operating the switch (14), said garment comprising:

a button exposing hole (32) for exposing at least a portion of the button (14*a*) of said switch (14) and said sound outputting element (12) in front of it;

an outputting element passing-through hole (34);

a non-woven fabric pocket (30) having a cover portion (39) for opening or covering an a first opening portion (38) formed on the upper end of it by means of a first velcro tape (36);

a cutting portion (56) being sewn within an inner surface of the garment (40), having a second opening portion (54) on the upper thereof opened or closed by a second velcro tape (52) and exposing a button (14*a*) from the front of the garment (40) in a state that said non-woven fabric pocket (30) is received into the inner of the garment (40);

an internal pocket (50) having a sound wave passing hole (58) for passing a sound wave being generated from said sound outputting element (12);

an auxiliarly button (60) being attached in front of the garment (40) so as to cover from outside said cutting portion (56) formed in the garment (40) and having a button inserting hole (62) for inserting a button (14); and a moisture-proof paper (70) being positioned between an inner surface of said non-woven fabric pocket (30) and an rear surface of said printed circuit board (20).

2. A garment capable of outputting a sound as claimed in claim 1, further comprising a light emitting diode being connected to said sound outputting element (12) in parallel.

3. A garment capable of outputting a sound as claimed in claim 1, wherein said light emitting diode is positioned on the inner of the garment.

4. A garment capable of outputting a sound as claimed in claim 1, wherein said light emitting diode is exposed to the outer of the garment.

* * * * *